US007147016B1

(12) United States Patent
Nelson et al.

(10) Patent No.: US 7,147,016 B1
(45) Date of Patent: Dec. 12, 2006

(54) BALLOON INFLATION DEVICE

(75) Inventors: David C. Nelson, Akron, OH (US); Michael J. Frazier, Waterloo, WI (US); John J. Andrisin, III, Brunswick, OH (US); Martin A. Meluch, Newton Falls, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 0 days.

(21) Appl. No.: 11/202,912

(22) Filed: Aug. 12, 2005

(51) Int. Cl.
*B65B 1/04* (2006.01)

(52) U.S. Cl. ..... 141/114; 141/313; 53/79

(58) Field of Classification Search ..... 141/114, 141/313–317, 97; 53/79, 84, 88, 385.1, 403, 53/459, 469
See application file for complete search history.

(56) References Cited

U.S. PATENT DOCUMENTS

| | | | | |
|---|---|---|---|---|
| 3,561,579 | A | 2/1971 | Allison | 194/219 |
| 4,088,161 | A | 5/1978 | Ikemoto | 141/167 |
| 5,121,595 | A | 6/1992 | Shore | 53/79 |
| 5,370,161 | A | 12/1994 | Shafer | 141/114 |
| 5,651,402 | A | 7/1997 | McCaul | 141/314 |
| 5,653,272 | A | 8/1997 | McCaul | 141/314 |
| 6,634,394 | B1 | 10/2003 | Nelson et al. | 141/114 |

*Primary Examiner*—Steven O. Douglas
(74) *Attorney, Agent, or Firm*—Renner, Kenner, Greive, Bobak, Taylor & Weber

(57) ABSTRACT

A balloon inflation device for use with a keyed balloon weight associated with a balloon to be filled with gas includes a source of pressurized gas sending gas through gas lines and multiple valves associated with an inflation block, wherein each valve is opened by properly manipulating elements of the inflation block. A key weight valve is opened by placing a key weight into a key weight receptacle in the inflation block, and a clamp valve is opened by manipulating a clamp mechanism. The key weight is associated with a balloon having a open neck that is placed over an inflation nozzle of the inflation block, before placing the key weight into the key weight receptacle. The clamp mechanism clamps the neck of the balloon to the inflation nozzle as it opens the clamp valve. With both valves open, gas may flow to the inflation nozzle to fill the balloon.

7 Claims, 7 Drawing Sheets

BALLOON INFLATION DEVICE

TECHNICAL FIELD

The invention herein resides generally in the art of balloon inflation devices. More particularly, the present invention relates to a balloon inflation device that is safe for consumer use.

BACKGROUND OF THE INVENTION

The prior art has provided balloon inflation devices for filling balloons with lighter-than-air gases, like helium. These devices have been provided not only to facilitate the production of filled balloons but also to avoid some of the inherent dangers involved in using a pressurized gas to inflate balloons. Typically, trained personnel are required to operate balloon inflation devices that employ pressurized gas. Employing such personnel is an added expense of providing inflated balloons, and it is therefore desirable to provide a balloon inflation device that can be safely used by the average consumer.

Although several automated balloon inflation devices are available, there are very few readily usable by the average consumer. In some of these devices, the consumer has direct access to the source of pressurized gas. If the gas is an inert gas, such as helium, it is conceivable that the consumer could become asphyxiated if the gas was inhaled. Furthermore, if a consumer were to place their mouth directly on the nozzle of the pressurized gas supply, the pressure could severely injure that consumer's lungs.

U.S. Pat. No. 5,653,272 and U.S. Pat. No. 5,651,402 disclosed devices that prevent access to the pressurized gas supply by retaining a majority of the inflation device components inside a cabinet, and by assuring that a balloon placed on the inflation nozzle of the device is not inflated (i.e., pressurized gas is not released) until the cabinet is closed. These prior art inflation devices also divert a portion of the pressurized gas supply to activate a clamping mechanism for clamping the neck of the balloon over the inflation nozzle. These utilitarian aspects, while overcoming some of the inherent problems in balloon inflation as mentioned above, are not time efficient in use, and are more complicated in construction than is necessary. The consumers perceive these devices as being complicated and are thus less likely to desire to use them.

U.S. Pat. No. 6,634,394 teaches an improved design for a balloon inflation device wherein a consumer physically manipulates a slide valve that is associated with an inflation nozzle, sealing the balloon neck around the inflation nozzle by squeezing the neck against a collar with his fingers, and pushing on the collar to open the slide valve to the flow of pressurized gas. Those devices have not been found to be commercially viable because the squeezing of the neck against the collar typically provides inadequate sealing between the balloon and the inflation nozzle, leaking gas to the atmosphere. Also, there is nothing to prevent an individual from activating the flow of the pressurized gas (as, for example, by paying an appropriate price to turn the system "on") and pushing up on the collar to release the gas without having placed a balloon over the nozzle. This might be done in an attempt to inhale the gas, typically helium, in order to make one's voice higher. Inhaling helium in not healthy and is to be avoided, and thus the prior art 6,634,394 patent is not as suitable for commercial use as would be desired by those wishing to offer balloon inflation devices for use by customers.

The type and quality of balloon employed with the inflation devices are also important. The gas employed is pressurized, so the balloon must be suitably strong to prevent its bursting during inflation. Also, it is preferred that the balloons employed seal to hold the gas without the need for tying or otherwise taking additional steps to manipulate the balloon. Thus, it is desired that the balloons employed with the inflation device include self-sealing valves. The art would benefit from means for ensuring that only the right type and quality of balloon is accepted for use by the inflation device.

Based upon the foregoing, it is evident that there is a need for an automated balloon inflation device that can be safely used by the average consumer, with a proper seal achieved between the balloon and the inflation nozzle when used. There is also a need for an inflation device that has means for helping to ensure that only the right type and quality of balloon is filled by the device.

SUMMARY OF THE INVENTION

This invention generally provides a balloon inflation device for use with a key weight and a balloon to be filled with gas. The balloon inflation device includes a source of pressurized gas and a first gas feed line communicating between the source of pressurized gas and a first valve. A second gas feed line communicates between the first valve and a second valve, and opening the first valve opens a passage between the first gas feed line and the second gas feed line through the first valve. A gas fill line communicates between the second valve and an inflation nozzle that selectively receives the neck of the balloon to communicate with the interior of the balloon. A key weight receptacle selectively receives the key weight, with receipt of the key weight opening one of the first and second valves. A clamp mechanism is selectively manipulated to seal against the inflation nozzle, with such selective manipulation also opening the other of the first and second valve that is not opened by receipt of the key weight in the key weight receptacle.

PREFERRED EMBODIMENT FOR CARRYING OUT THE INVENTION

Figure 1:
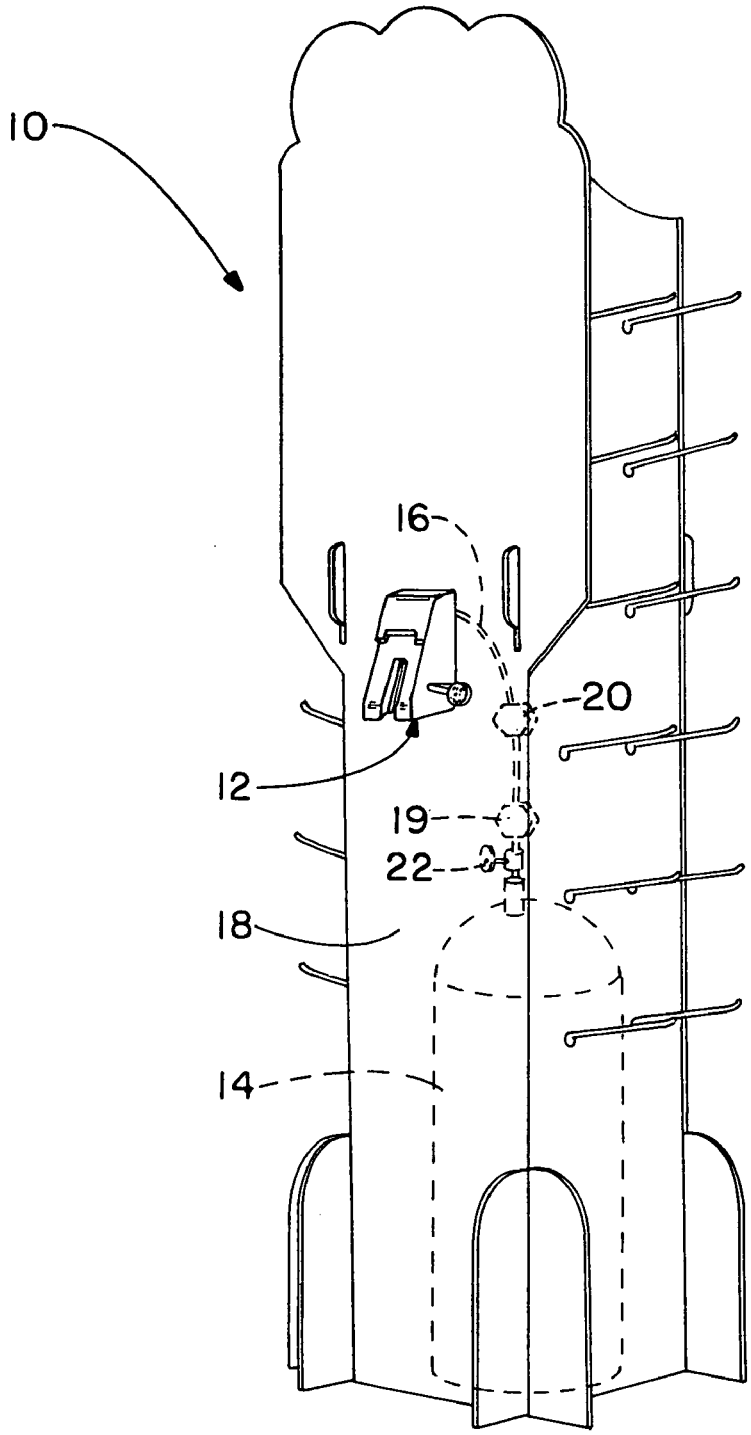
FIG. 1 is a perspective view of a balloon inflation device in accordance with this invention.

With reference to FIG. 1, it can be seen that a balloon inflation device according to the present invention is designated generally by the numeral 10. Balloon inflation device 10 includes an inflation block 12 that communicates with a pressurized gas source 14 through a feed line 16. For aesthetic reasons, as well as to restrict access to the pressurized gas source 14, the pressurized gas source 14 and feed lines 16 are preferably retained within a housing 18, while the inflation block 12 is provided on the outside of the housing 18 to allow for consumer access thereto for inflating balloons.

As is known, the gases employed to fill balloons, particularly helium, are typically supplied in pressurized tanks so that a large quantity of gas can be provided in a limited amount of space. Thus, the gas supplied is typically contained at a pressure of about 2200 to 2500 psi. This pressure is too great for inflating balloons. Therefore, a high pressure regulator 19, typically provided on the tank (i.e., gas source 14), is employed to regulate this pressure down to about 80 psi in feed line 16. A low pressure regulator 20 is provided downstream of high pressure regulator 19 to further reduce the pressure of the gas traveling from the pressurized gas source 14 to the inflation block 12. Preferably, one or more pressure regulators 20 are provided to reduce the pressure of the gas (at approx. 80 psi, due to the high pressure regulator) to less than about 3 psi in order to ensure satisfactory inflation of the balloon. Preferably, pressure regulator(s) 20 reduce the pressure to about 0.5 to about 1.5 psi. As is common, the pressurized gas source 14 has an open/close valve 22. Typically, open/close valve 22 is left open to allow for the flow of pressurized gas from the pressurized gas source 14 through high pressure regulator 19 and feed line 16. Open/close valve 22 may be left open due to the fact that, as described below, the inflation block 12 will not allow for the release of gas therethrough without actuation through inflation block 12.

Figure 3:
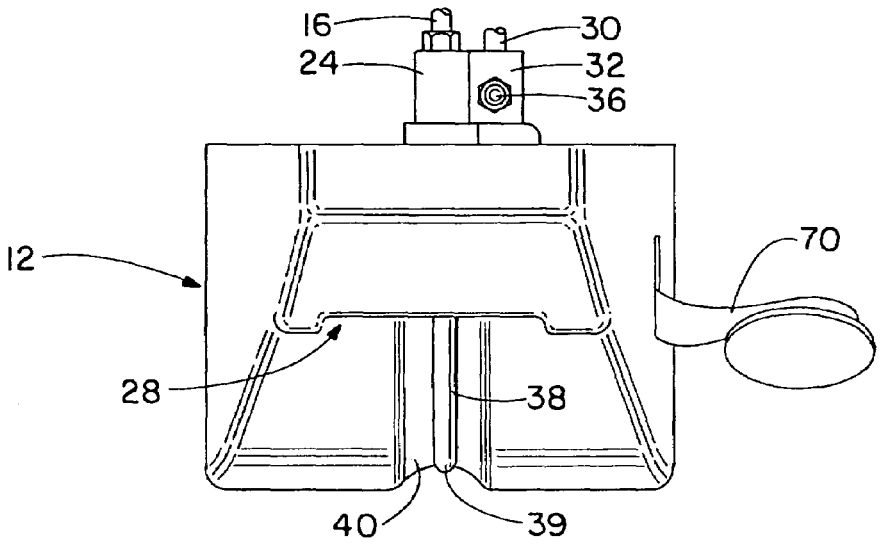
FIG. 3 is a top plan view of the inflation block.
Figure 2:
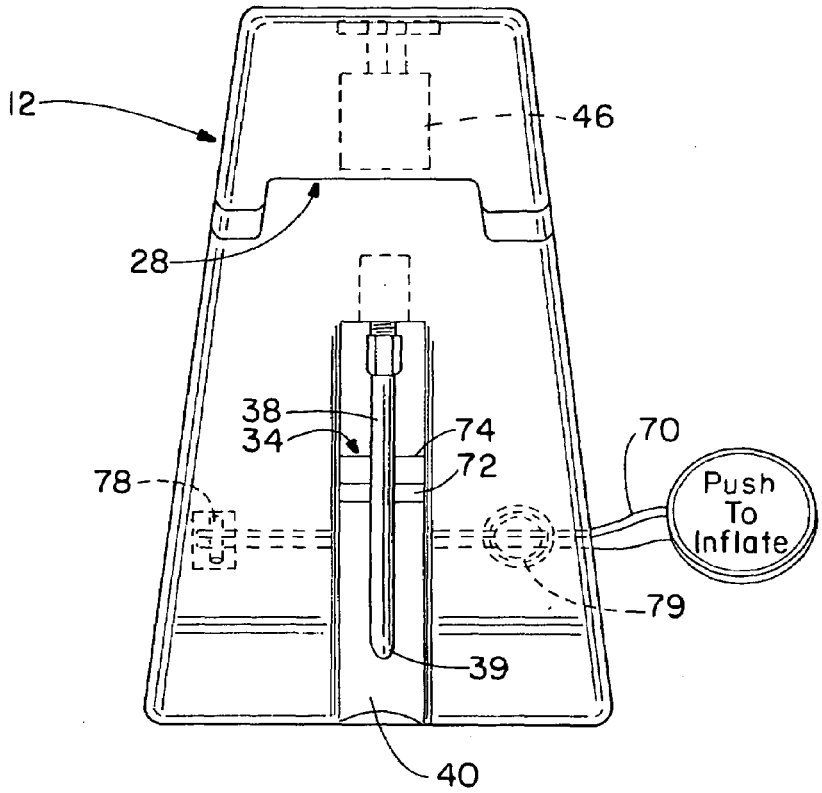
FIG. 2 is a front elevational view of an inflation block of the balloon inflation device.
Figure 4:
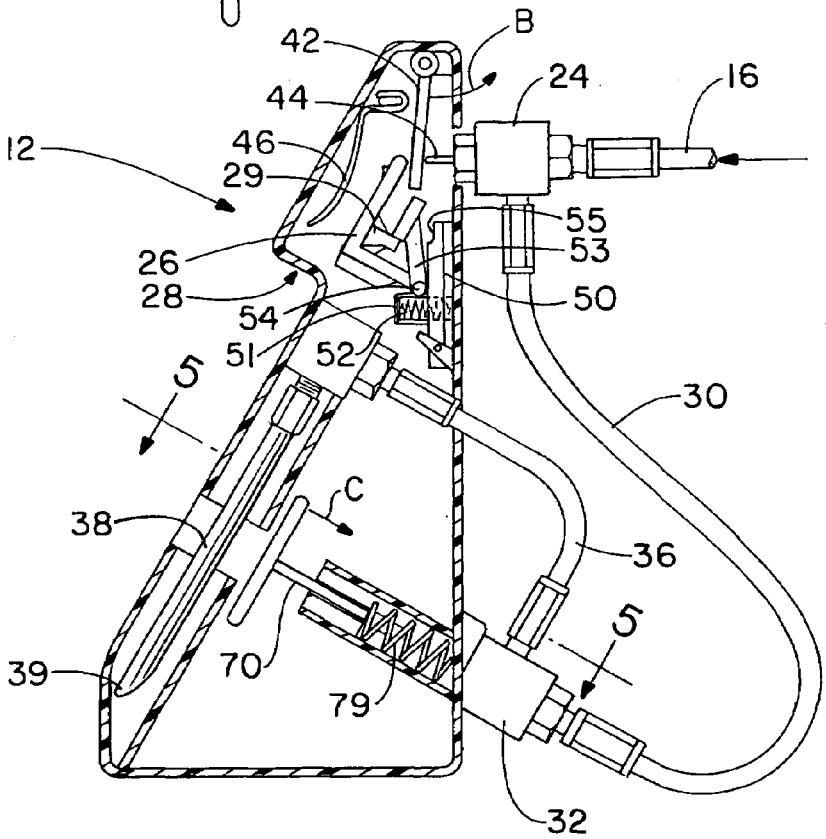
FIG. 4 is a side cross-sectional view of the inflation block, showing its interaction with a pressurized gas source.
Figure 9:
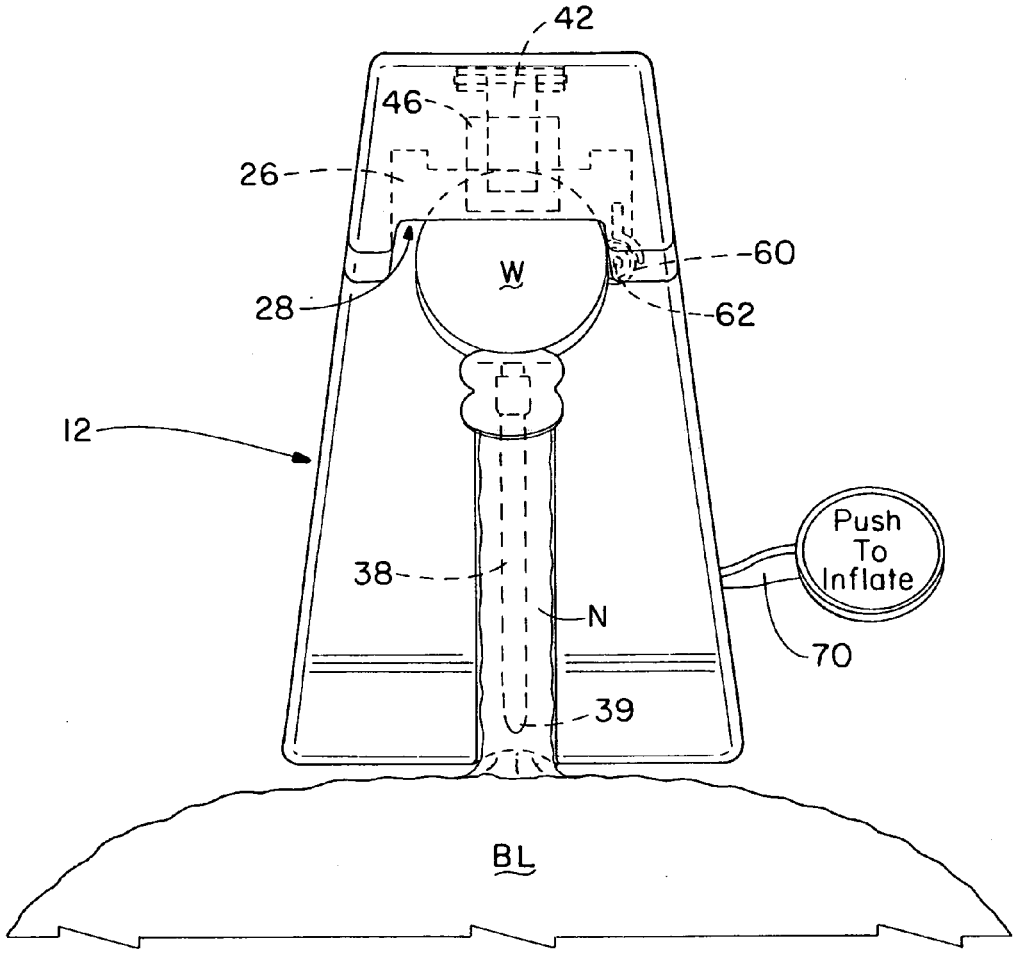
FIG. 9 is a front elevational view of the inflation block, shown with a balloon neck threaded onto the inflation nozzle with a key weight received in the key weight receptacle.

With particular reference to FIGS. 2–4, it can be seen that, in accordance with one embodiment of this invention, inflation block 12 receives feed line 16 at key weight valve 24. In this embodiment, the fill gas has traveled from source 14, through pressure regulators 19 and 20, and, thus, enters at key weight valve 24 at the reduced pressure (typically 0.5 to about 1.5 psi). Key weight valve 24 is normally closed to the flow of gas, but is selectively opened through manipulation of sliding tray 26 of key weight receptacle 28. When key weight valve 24 is opened, pressurized gas fed through feed lines 16 travels to a second feed line 30, which runs to balloon clamp valve 32. Balloon clamp valve 32 is normally closed to the flow of gas, but is opened upon actuation of clamping mechanism 34. Activating clamp mechanism 34, thus opening balloon clamp valve 32, allows gas to flow to fill line 36 and, from there, through inflation nozzle 38. Thus, a balloon may be inflated by pulling its neck over inflation nozzle 38 and thereafter opening both the key weight valve 24 and the balloon clamp valve 32. First, a balloon neck is pulled over inflation nozzle 38 and a keyed balloon weight (herein also "key weight") is inserted into key weight receptacle 28 to push sliding tray 26 to a position that opens key weight valve 24. Thereafter, clamp mechanism 34 is activated to clamp the balloon neck against the inflation nozzle with an airtight seal and, at the same time, open balloon clamp valve 32 to allow gas to flow into and fill the balloon. The general positioning of a balloon BL and key weight W after pulling the neck N of the balloon BL over nozzle 38 and pushing the sliding tray 26 with weight W to open key weight valve 24 is shown in FIG. 9. From the position of FIG. 9, the clamp mechanism 34 is activated and the balloon clamp valve 32 is opened by pushing clamp lever 70.

Figure 14:
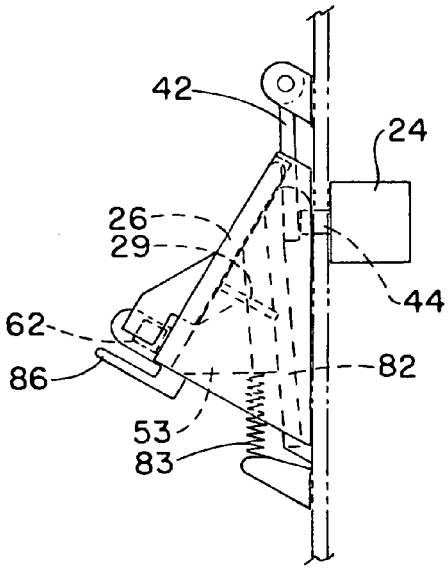
FIG. 14 is a partial side elevational view of the sliding tray and key interaction of FIG. 13.
Figure 15:
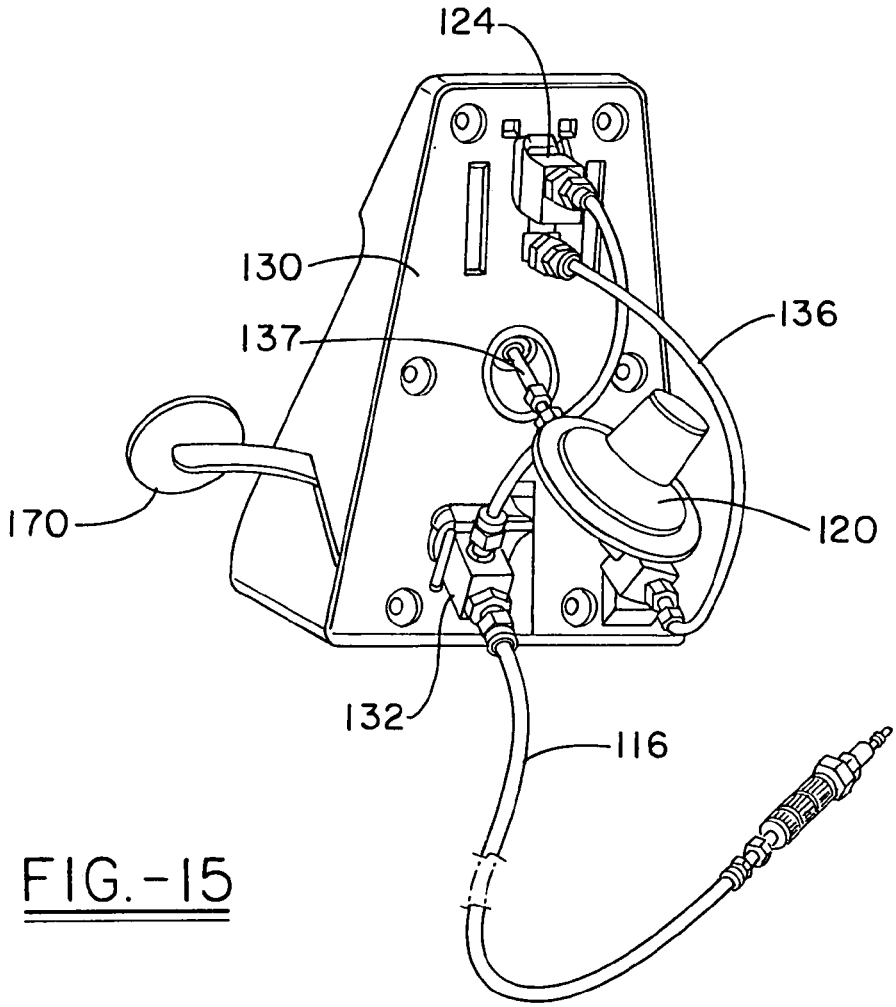
FIG. 15 is a perspective view of an inflation block having an alternative gas line, valving and pressure regulator configuration in accordance with a preferred embodiment.

An alternative, preferred configuration for the fill lines and valves and regulators is provided in FIG. 15. Therein, like parts to those in FIGS. 2–4 receive like numerals but increased by 100. Fill line 116 communicates first with balloon clamp valve 132, which is selectively opened by pushing clamp lever 170. Once balloon clamp valve 132 is opened, gas flows through second feed line 130, which communicates between balloon clamp valve 132 and key weight valve 124. Key weight valve 124 is selectively opened through manipulation of a sliding tray of a key weight receptacle, substantially as shown and discussed with respect to the embodiments of FIGS. 1–14, it being appreciated that this embodiment of FIG. 15 is concerned with the alternative configuration for fill lines, valves and regulators, all other aspects of the invention remaining substantially as disclosed with respect to the other embodiments. Once key weight valve 124 is opened, gas can flow to fill line 136 and, ultimately, to the inflation nozzle (not shown). In this embodiment, however, low pressure regulator 120 is positioned in fill line 136, such that gas at the pressure regulated by high pressure regulator 19 (as mentioned, typically about 80 psi) flows through feed line 116, second feed line 130 and through a portion of fill line 136 at the higher pressure, and is only regulated down to an appropriate desired fill pressure (typically 0.5 to 1.5 psi) directly before the inflation nozzle. It has been found that this configuration, wherein relatively high pressure gas, preferably at from about 50 to 100 psi (typically about 80 psi), is fed through the majority of the fill lines and valves, and is reduced to a fill pressure, preferably from 0.5 to 1.5 psi, directly before the inflation nozzle, results in a relatively quiet operation. Configurations such as that shown in FIG. 4, wherein the gas is reduced to a low pressure along the feed line (i.e., line 16), before traveling through the valves and secondary feed lines and fill lines of the inflation block, produce harmonic resonance and loud squealing noises. A rigid line, preferably of brass material, is preferably employed to feed gas from regulator 120 to the inflation nozzle (which is also generally rigid), as shown at 137, because this reduces resonance and noise.

Inflation nozzle 38 includes a beveled tip 39 to facilitate pulling neck N of balloon B there over, and nozzle 38 is substantially enclosed by cylindrical trough 40. Inflation nozzle 38 also preferably extends substantially downwardly, and, in preferred embodiments, may include auxiliary holes or flutes. These aspects of designing inflation nozzle 38 within inflation block 12 are disclosed in prior U.S. Pat. No. 6,634,394.

Figure 7:
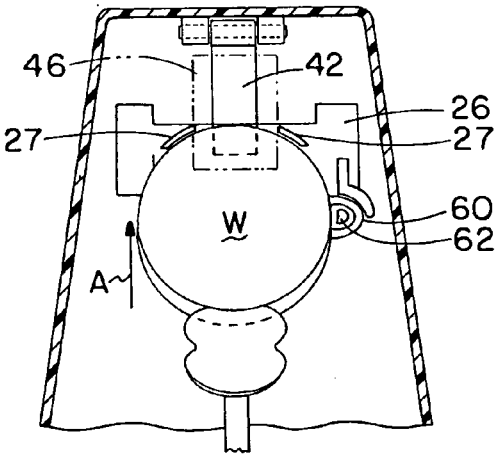
FIG. 7 is a partial front elevational view of the top portion of the inflation block, with a front housing of the inflation block removed to show the receipt of a key weight in the inflation block.
Figure 8:
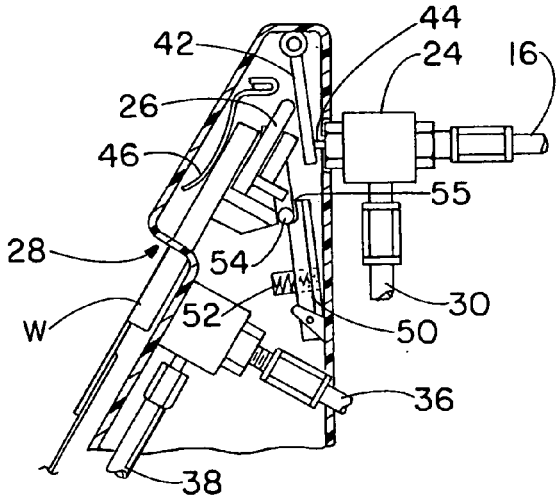
FIG. 8 is a partial side cross-sectional view of the top portion of the inflation block as in FIG. 7, showing the receipt of a key weight therein.

The general functioning of key weight receptacle 28 is disclosed with reference to FIGS. 4, 7 and 8. As mentioned, key weight receptacle 28 includes sliding tray 26, which moves to selectively open key weight valve 24. Sliding tray 26 is shown in the normal rest position in FIG. 4. Receipt of a key weight W is shown in a front elevational view in FIG. 7. Weight W is inserted through opening 28, in the direction of arrow A, and engages sliding tray 26 at raised rims 27. Pushing further in the direction of arrow A causes sliding tray 26 to engage valve lever 42, pushing it in the direction of arrow B against valve pin 44, which opens and closes key weight valve 24. As seen in a comparison of FIGS. 4 and 8, when sliding tray 26 is moved sufficiently in the direction of arrow A, valve pin 44 is moved sufficiently to open key weight valve 24 in a known manner. A clip 46 may be employed to grip key weight W to hold weight W and sliding tray 26 in position to retain key weight valve 24 in the open state. Clip 46 would preferably be constructed from somewhat resilient materials, strong enough to frictionally engage key weight W and retain the position of sliding tray 26, and yet allow the for removal simply by pulling on weight W in a direction opposite to arrow A.

As an alternative to (or in addition to) clip 46, lock plate 50 may be employed. Lock plate 50 would be biased to push against sliding tray 26, as shown in FIGS. 4 and 8 at receipt cup 51 and spring 52. Spring 52 pushes plate 50 toward key tray 53, which is caused to move with sliding tray 26 by being engaged by one or more lift members 29 extending from sliding tray 26. Thus, bottom edge 54 of key tray 53 engages catch step 55 at the top of lock plate 50, when sliding tray 26 is moved upward and pulls key tray 53 upward, as shown in a comparison of FIGS. 4 and 8. The engagement of step 55 with edge 54 helps hold key tray 53 in its new position, and this maintains an engagement between an optional eyelet on a key weight W and a key on key tray 53. This optional provision of an eyelet and a key is next disclosed.

Figure 10A:
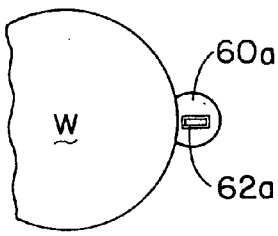
FIGS. 10A, 10B and 10C are partial plan views showing alternative configurations for a key weight eyelet for interacting with alternative configurations of a key for purposes of controlling the quality of the balloons for safety and other reasons.
Figure 10B:
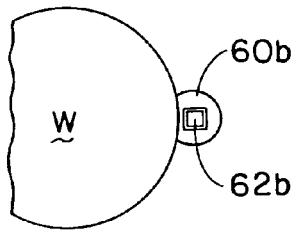
Figure 10C:
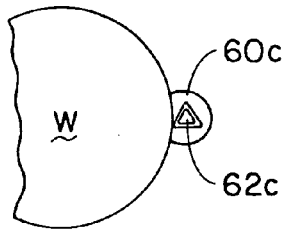
Figure 11:
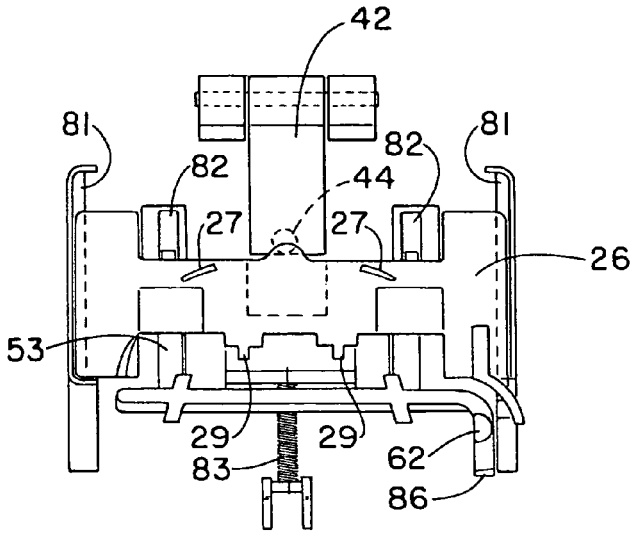
FIG. 11 is a partial front elevational view of the inflation block, with its front housing removed to illustrate a particularly detailed embodiment of a slid tray and its interaction with a key, with the sliding tray shown down in a normal rest position.

It will be appreciated that there are safety concerns when employing pressurized gas, especially an inert gas, such as helium, which is commonly used to inflate balloons. The balloons must be made to not burst at the desired inflation pressure. Additionally, they should preferably be self-sealing upon removal from the inflation nozzle so that the individual filling the balloon does not have to tie or otherwise manipulate it. Thus, the quality and type of the balloons employed in accordance with this process will be a factor in the successful development of a market for the balloon inflation devices. Quality and type control measures are disclosed with reference to FIG. 7. Particularly, key weights W are preferably provided with specific configurations that will only be accepted by specific inflation blocks 12, particularly by those having specific key tray configurations. In this way, only specific key weights W affixed to balloons of suitable quality and type can be inserted into key weight receptacle 28 to open key weight valve 24, thus preventing the use of inferior balloons affixed to non-specific keyed balloon weights. In this embodiment, key weight W includes a specific configuration at eyelet 60 that receives a specifically configured key 62 on key tray 53 as key weight W is fully inserted into opening 40 in the direction of arrow A. If the configuration of an eyelet cannot accept key 62, then the key weight with that improper eyelet cannot be fully inserted, and valve 24 cannot be opened. Thus, by providing distributors with a given inflation block 12 that will receive only a given key weight W with a specific configuration, the quality and type of the balloons employed with the balloon inflation device 10 can be assured by only associating balloons of appropriate quality and type with the appropriately configured key weights. This general concept is shown in FIGS. 10A, 10B and 10C, wherein different eyelet configurations and appropriately shaped keys are shown. A rectangular eyelet 60*a* and rectangular key 62*a* interact in FIG. 10A. A square eyelet 60*b* and square key 62*b* interact in FIG. 10B. A triangular eyelet 60*c* and triangular key 62*c* interact in FIG. 10C.

Figure 12:
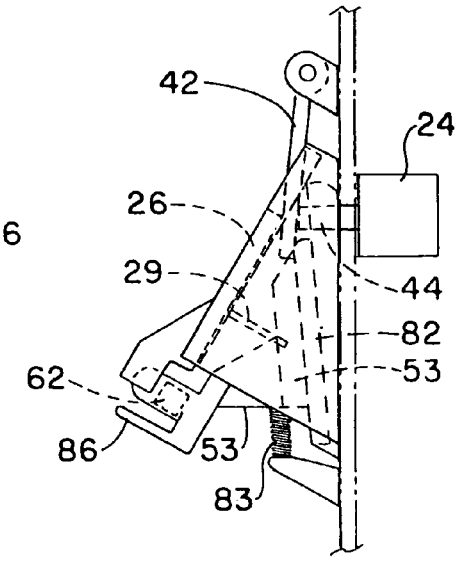
FIG. 12 is a partial side elevational view of the sliding tray and key interaction of FIG. 11.
Figure 13:
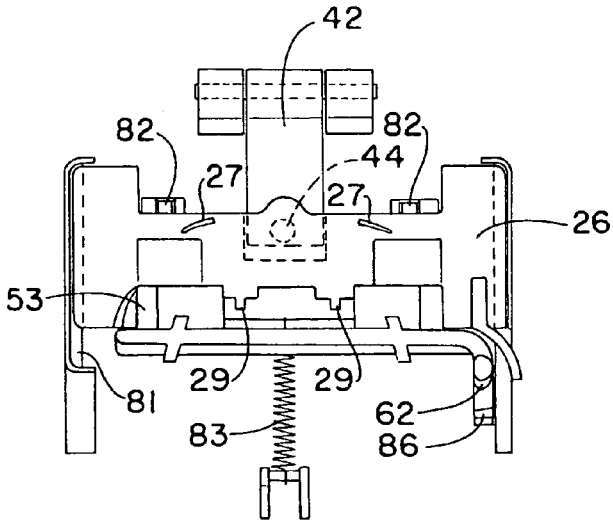
FIG. 13 is a partial front elevational view of the particular embodiment of preceding FIGS. 11 and 12, with the sliding tray shown pushed up into a position that opens the key weight valve, though shown without the key weight that would normally be employed to push the sliding tray.

The specifics of the key tray and key provided thereby are better discerned from the views presented in FIGS. 11–14, and these figures are now referred to in order to better understand the configuration and functioning of the sliding tray, key tray and key in accordance with an embodiment of this invention. Sliding tray 26 rides in side channels 81. Key tray 53 rides in channels 82, which, as can be best seen in FIGS. 12 and 14, are angled from bottom to top, toward sliding tray 26. Thus, when lift members 29 engage key tray 53 and push it upward (i.e., upon the upward movement of sliding tray 26), key tray 53 is also moved toward sliding tray 26 (i.e., to the left in FIGS. 12 and 14). This moves key 62 of key tray 53 to the left as well, and causes it to engage an appropriately configured eyelet in a key weight, once fully inserted as already disclosed. Key tray 53 is biased downwardly to the position of FIG. 11 by an appropriate biasing member, here spring 83, but either the clip 46 or lock plate 50 (see FIGS. 4 and 8) or both are employed to counter the bias enough to retain key tray 53 in the upward position of FIG. 13. When the resistance offered by clip 46 or lock plate 50 is overcome, which is generally done when a key weight is removed from insertion into key weight receptacle 28, with an eyelet engaging release extension 86 to push downwardly on and release trays 26 and 53 from either clip 46 or lock plate 50, spring 83 ensures that key tray 53 returns to its rest position, pulling sliding tray 26 with it and permitting the closing of key weight valve 24.

Figure 5:
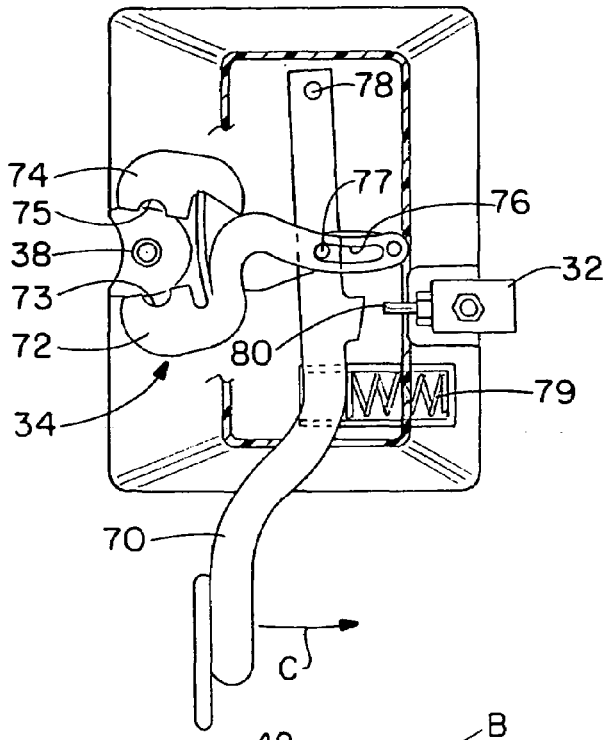
FIG. 5 is a top cross-sectional view taken along the line 5—5 in FIG. 4 and showing particulars of a clamp mechanism of the inflation block in an open position.
Figure 6:
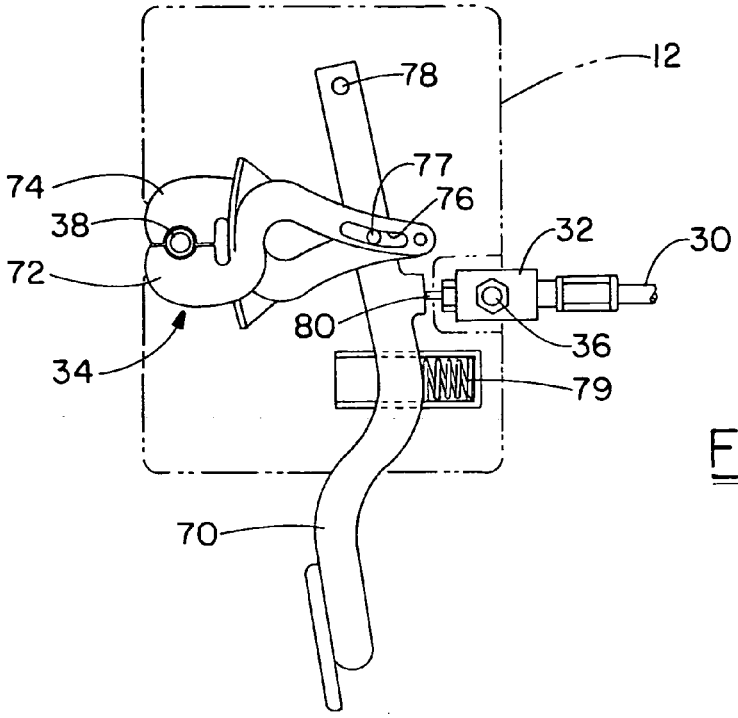
FIG. 6 is a top cross-sectional view, as in FIG. 5, showing particulars of a clamp mechanism of the inflation block in a closed position.

After the balloon neck is threaded over inflation nozzle 38, and key weight W is inserted into key weight receptacle 28 to open key weight valve 24, the balloon may be inflated by actuating clamp mechanism 34 to grip the neck of the balloon against inflation nozzle 38 and open balloon clamp valve 32. Elements of clamp mechanism 34 are best seen in FIGS. 5 and 6, although other figures will help the skilled artisan to appreciate the operation of this mechanism. Clamp mechanism 34 includes clamp lever 70 that may be pushed to bring opposed scissor members 72, 74 into engagement with inflation nozzle 38 at their respective nozzle engagement surfaces 73, 75. Scissor members 72, 74 each include an arced channel 76 that interacts with lever pin 77 to cause nozzle engagement surfaces 73, 75 to move toward or away from each other in a known manner. Only one arced channel 76 is seen in the figures, and it should be understood the orientation of arced channel 76 in scissor member 72 is flipped along a horizontal, as compared to the unseen arced channel in scissor member 74. This should be well understood, as it is the opposed orientation of the arced channels that permits the clamping and opening of the scissor members 72, 74 upon movement of pin 77 by lever 70. Clamp lever 70 pivots at pivot 78, and is biased to the position of FIG. 5 (wherein scissor members 72, 74 do not engage inflation nozzle 38) by spring 79, and, when moved against this spring in the direction of arrow C, lever pin 77 moves through arced channels 76 to bring nozzle engagement surfaces 73, 75 into contact with inflation nozzle 38 to hold the balloon neck against nozzle 38 with an airtight seal. Surfaces 73, 75 may be formed from or coated with a suitable elastomer to help create that seal. As lever 70 is pushed in the direction of arrow C it also engages valve pin 80 associated with balloon clamp valve 32. By pushing in on valve pin 80, balloon clamp valve 32 is opened, and gas can now flow all the way from feed line 16 through fill line 36 and inflation nozzle 38, into the balloon threaded over inflation nozzle 38. Pressure regulator 20 preferably assures that the balloon is filled to the desired pressure, and when the balloon is fully inflated to the desired pressure the back pressure from the balloon automatically shuts off the low pressure regulator and the flow of gas (typically helium).

A balloon can be quickly and safely inflated by any consumer that is able to read and follow instructions and/or diagrams substantively similar to the following: (1) locate inflation hole on the neck of the balloon and insert inflation nozzle into the hole and pull the balloon neck to the top of the inflation nozzle; (2) fully insert the keyed balloon weight into the key weight receptacle; (3) push the clamp lever to clamp the neck of the balloon to the inflation nozzle, wait for the balloon to be fully inflated, and slide the balloon off of the inflation nozzle. These instructions are simple to understand and easy to follow, and, thus, the present invention provides a balloon inflation device that is an advancement over the prior art in at least its ease of operation.

To maintain safety, specific balloons (quality and type) with specific key weight configurations are designed to be employed with specific key weight receptacles. At least one pre-packaged empty balloon with an attached key weight of a specific configuration is provided for purchase and for inflation with a specific balloon inflation device. By providing pre-packaged empty balloons with specific attached key weights for use only in conjunction with a specific balloon inflation device, there is an assurance that consumers will be providing themselves with balloons that are in accordance with state laws regarding lighter-than-air balloons. It will also ensure that the balloon being used is a suitable quality and type.

While in accordance with the patent statues only the preferred embodiments of the present invention have been described in detail, the present invention is not to be limited thereto or thereby. Rather, the scope of the invention shall include all-modifications and variations that fall within the scope of the attached claims.

What is claimed is:

1. A balloon inflation device for use with a key weight and a balloon to be filled with gas, the balloon having a neck, the balloon inflation device comprising:

a source of pressurized gas;

a first gas feed line communicating between said source of pressurized gas and a first valve;

a second gas feed line connected between said first valve and a second valve, wherein the opening of said first valve opens a passage between said first gas feed line and said second gas feed line through said first valve;

a gas fill line communicating between said second valve and an inflation nozzle that selectively receives the neck of the balloon to communicate with the interior of the balloon;

a key weight receptacle that selectively receives the key weight, with receipt of the key weight opening a valve selected from said first valve and said second valve; and a clamp mechanism selectively manipulated to seal against said inflation nozzle, with such selective manipulation also opening the other of said first valve and said second valve that is not opened by receipt of the key weight in the key weight receptacle.

2. The balloon inflation device of claim 1 wherein said key weight receptacle includes a sliding tray movable between a rest position and a weight receipt position, wherein said weight receipt position is achieved by placing said key weight in said key weight receptacle, said sliding tray opening the valve selected from said first valve and said second valve when in said weight receipt position.

3. The balloon inflation device of claim 2 wherein said key weight receptacle includes means for receiving only a key weight of a given configuration.

4. The balloon inflation device of claim 3 wherein said means for receiving only a key weight of a given configuration includes a key that engages an eyelet on the key weight when the key weight is placed in said sliding tray and said sliding tray is moved to the weight receipt position.

5. The balloon inflation device of claim 2 further comprising a lock plate that engages said sliding tray in said weight receipt position to hold it in such position.

6. The balloon inflation device of claim 1 wherein said clamp mechanism includes a clamp lever and opposed scissor members that close on and seal against said inflation nozzle when said clamp lever is manipulated to open the other of said first valve and said second valve that is not opened by receipt of the key weight in the key weight receptacle.

7. The balloon inflation device of claim 6 wherein said first valve, said key weight receptacle, said second gas feed line, said second valve, said gas fill line, said clamp mechanism, and said clamp lever are all provided in an inflation block unit.

* * * * *